US005356033A

United States Patent [19]

Delaney

[11] Patent Number: 5,356,033

[45] Date of Patent: Oct. 18, 1994

[54] BEVERAGE DISPENSING METHOD AND APPARATUS

[76] Inventor: David Delaney, 1185 E. 2nd St., Winnemucca, Nev. 89445

[21] Appl. No.: 985,167

[22] Filed: Dec. 1, 1992

[51] Int. Cl.[5] ..... G07F 11/34

[52] U.S. Cl. ..... 221/194; 221/150 R; 221/283; 221/285; 221/261; 221/277; 221/281

[58] Field of Search ..... 221/283, 285, 150 R, 221/194, 255, 261, 277, 281, 268

[56] References Cited

U.S. PATENT DOCUMENTS

| | | | |
|---|---|---|---|
| 1,004,998 | 10/1911 | Crecelius | 221/261 X |
| 2,852,327 | 9/1958 | Mason | 221/283 X |
| 3,254,792 | 6/1966 | Danielson et al. | 221/261 X |
| 4,485,937 | 12/1984 | Adams | 221/150 R |
| 4,712,712 | 12/1987 | Garden | 221/281 X |
| 4,744,489 | 5/1988 | Binder et al. | 221/194 X |
| 5,046,639 | 9/1991 | Deberry | 221/194 X |
| 5,080,256 | 1/1992 | Rockola | 221/194 X |

FOREIGN PATENT DOCUMENTS

| | | |
|---|---|---|
| 689017 | 6/1964 | Canada . |
| 0499013 | 8/1992 | European Pat. Off. . |

*Primary Examiner*—Robert P. Olszewski
*Assistant Examiner*—Dean A. Reichard
*Attorney, Agent, or Firm*—Herbert C. Schulze

[57] ABSTRACT

A beverage can dispensing method and apparatus for use in a refrigerator comprising three angularly disposed shelves, two said shelves being angularly disposed from front to rear to enable cans to roll from front to rear. A third shelf angularly disposed in a downward direction from the rear to the front to allow cans to descend from said first two shelves to the third shelf and ultimately to the position of ejectment from the front of the dispenser and means cooperable therewith to raise a can for ejectment by reason of the pressure of other cans on said third shelf against a can in the ejectment position.

1 Claim, 3 Drawing Sheets

FIG. 2.
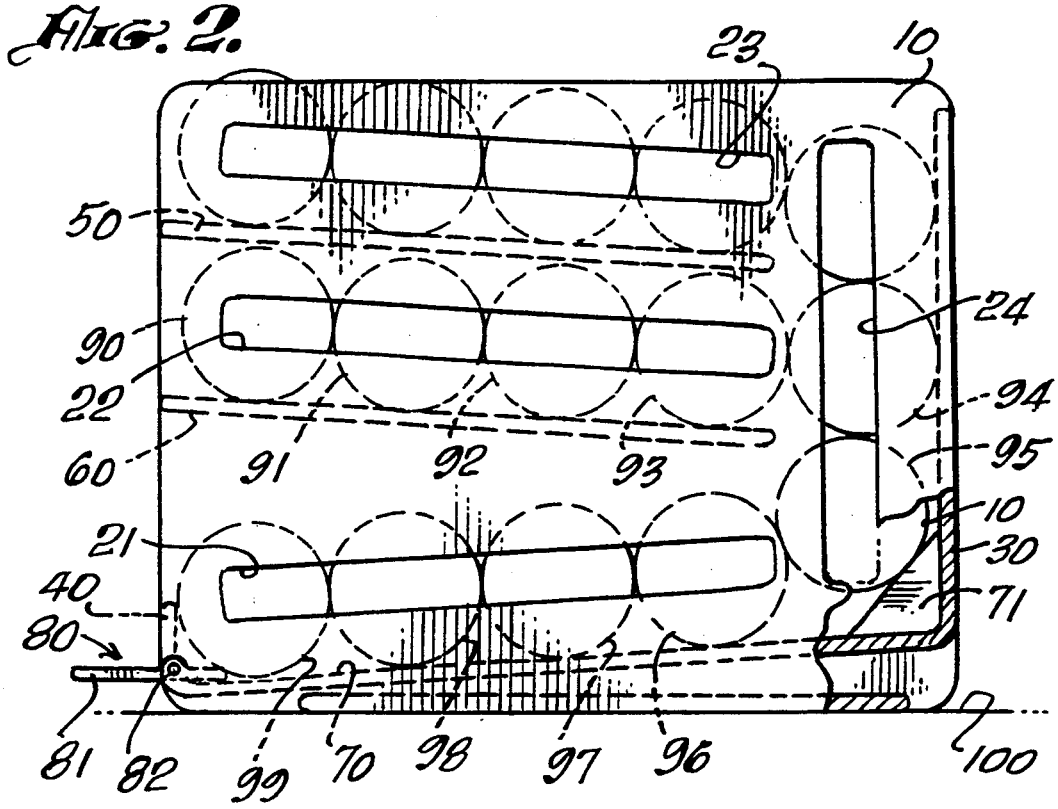
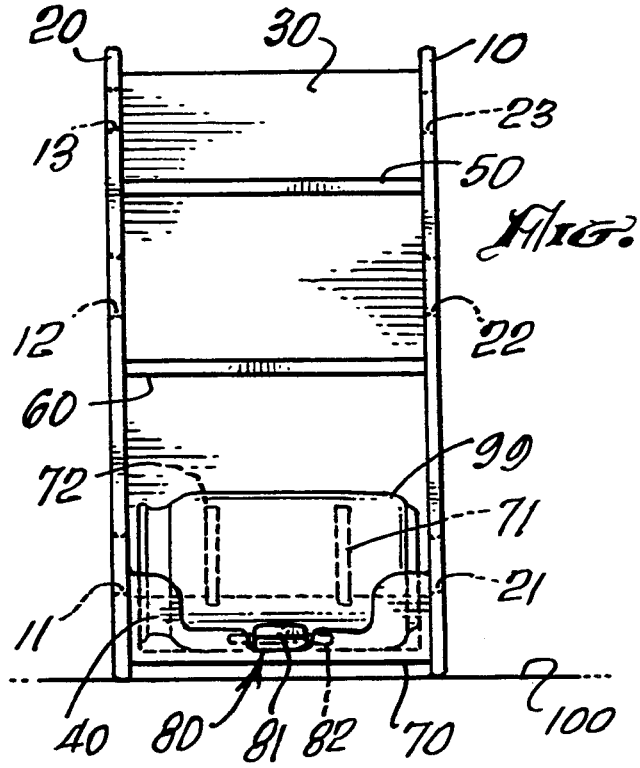
FIG. 3.

BEVERAGE DISPENSING METHOD AND APPARATUS

There are no patent applications filed by me related to this application.

BACKGROUND OF THE INVENTION

I. Field of the Invention

This invention is in the general field of beverage dispensing; the invention is more particularly directed to a method and apparatus for beverage dispensing, primarily, but not exclusively, designed for home use; the invention is even more particularly directed to a beverage dispensing method and apparatus wherein the apparatus is suitable to be mounted within a household refrigerator and designed to carry fifteen cans of beverage which self-feed, by gravity, to a dispensing arrangement.

II. Description of the Prior Art

I know of only one item which might be considered prior art as compared to my invention. That particular article is illustrated in FIG. A of the accompanying drawings, and is described in more detail in connection with the description of that figure of the drawing.

SUMMARY OF THE INVENTION

The storage of beverage cans ( particularly beverage cans containing soft drinks ) within a refrigerator is generally bothersome and takes up a great deal of valuable shelf space. Many people resort to stacking two or more six ( or twelve ) packs of a beverage on top of each other while still in their basic packages. This is cumbersome and removing a container at times becomes difficult when they are stored in this manner.

I know of one attempt which was made in the past to provide a can dispenser. This one item is illustrated in FIG. A of the drawings. It was capable of storing cans, but it had many deficiencies, including tendency for the cans to turn sideways and drop out improperly as well as a considerable difficulty being encountered in attempting to remove one can at a time for use, and inefficient use of the space required.

I have studied this problem at length and now devised a new three level gravity feed can dispenser which holds fifteen standard beverage cans in three tiers and with convenient can ejectment arrangements for ejecting a single can properly as desired.

I have accomplished the desired end by having a lower shelf angling downward from the rear of the device to the front with means to hold the cans in place until a single can is ejected by utilizing the unique features of the device. Additionally there are two tiers, or shelves, above the lower shelf and in this case those tiers are angled from front to back.

As will be explained in more detail below, this device is so arranged that cans are easily fed into position and easily ejected by the special construction as will be described in detail.

It is an object of this invention to provide a can dispenser for beverage cans to be used within a refrigerator;

Another object of this invention is to provide a can dispenser which will carry fifteen cans in three tiers;

Another object of this invention is to provide a can dispenser which can be easily loaded within a refrigerator;

Another object of this invention is to provide such a can dispenser as has been described wherein one can at a time can easily be ejected.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 2 is a right side elevation of FIG. 1 which has been broken away and sectioned;

FIG. 3 is a front elevation of the device of FIG. 1 showing a can in place ready to be dispensed;

DESCRIPTION OF A PREFERRED EMBODIMENT

Figure 7:
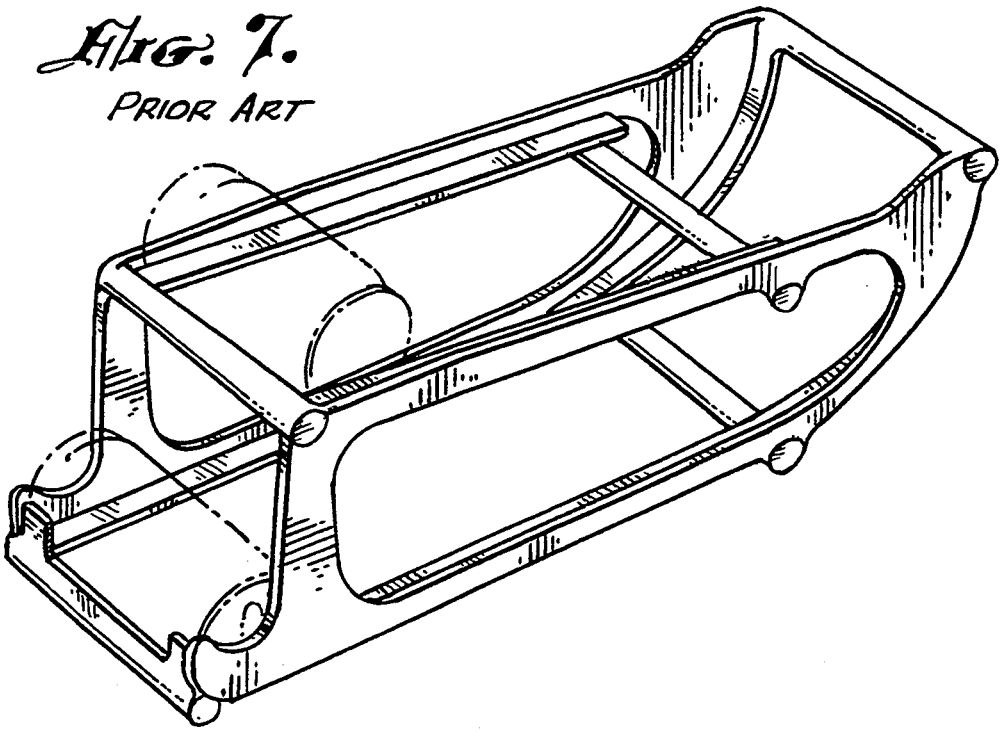
FIG. 7. PRIOR ART
FIG. 7 is a prospective, with cans in phantom, of the only prior art known to me.

FIG. 7 is solely for purposes of showing the only prior art of which I am aware in this field. It is shown that beverage cans can be inserted over the bar at the front. While this device was a distinct advance in the art, because of the nature of the slopes and angles provided the cans can easily, and do frequently, turn, drop out, or jam. Additionally, the cans are difficult to eject due to pressure against the front retainer and this device does not hold sufficient cans and it requires excessive space for the number of cans held.

Figure 1:
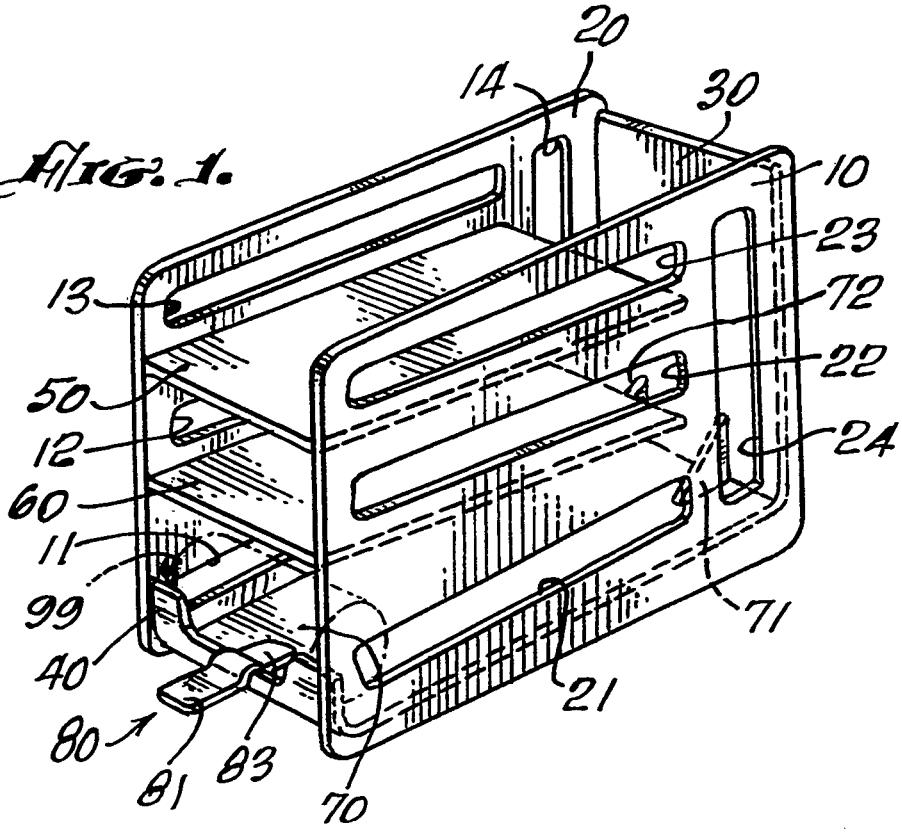
FIG. 1 is a perspective of an apparatus suitable to practice the method of this invention and embodying the features of my invention with a can shown in phantom at the ejectment position.

FIG. 1 is a perspective of an apparatus embodying the feature of my new invention and suitable to practice the method thereof. It can be seen that this apparatus comprises a pair of sides 10 and 20, a back end 30 and a front can stop 40. Can shelves 50, 60 and 70 are provided. It will be noted that the upper two can shelves operate with no stop or bumper of any type at the front end making it easy to roll cans down the shelves. Both of these shelves slope from an upward position to a lower position from the front to the back of the device. The third shelf, 70 slopes in the opposite direction and has a retaining element 40 to keep the cans from rolling out. The ejectment element 80 is shown and will be described in more detail below.

The two sides, 10 and 20 are provided with vertically disposed slots 14 and 24 as shown. Additionally the sides 10 and 20 are provided with angularly disposed slots 11, 12, 13 and 21, 22 and 23 respectively. These slots are deliberately designed to provide clear ventilation along the center of the ends of each can as it is in place in the device.

A pair of triangular deflector ribs have been provided at 71 and 72 to ensure that cans dropping from above cannot jam in this area. This is a very important feature and is deemed a superior advance in the art, since the deflectors ribs I have provided cannot cause any jamming nor will a can get hung up on them.

Figure 4:
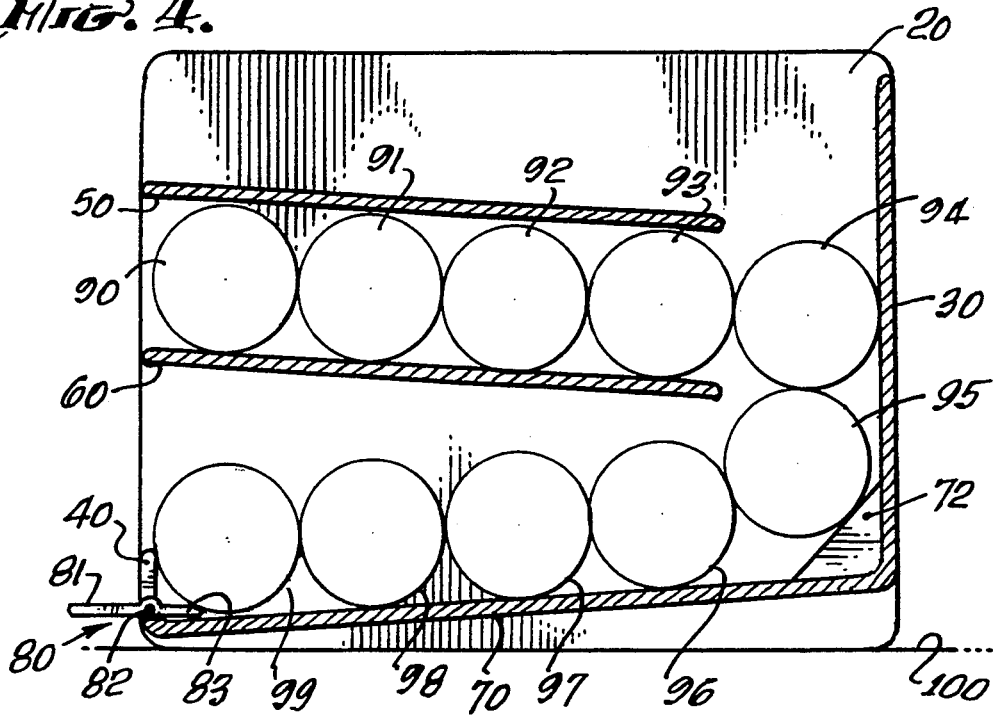
FIG. 4 is a sectioned, schematic view showing some cans in place and illustrating ejectment means at rest.
Figure 5:
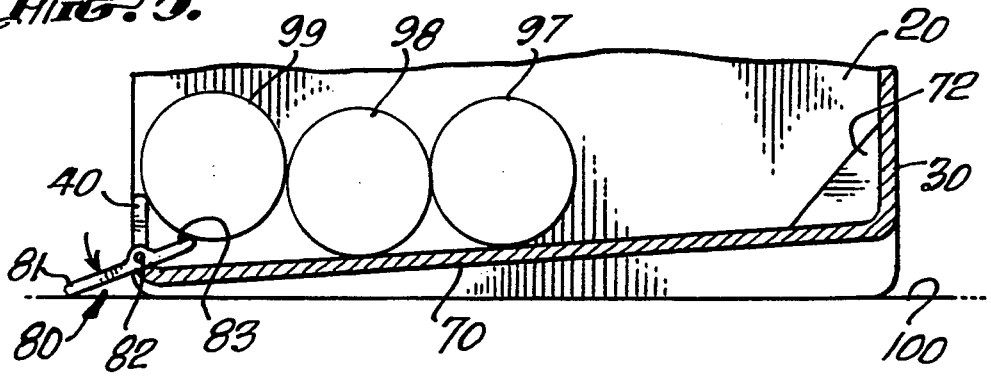
FIG. 5 is a broken away view of the lower portion of FIG. 4 showing the activation of the ejectment means.
Figure 6:
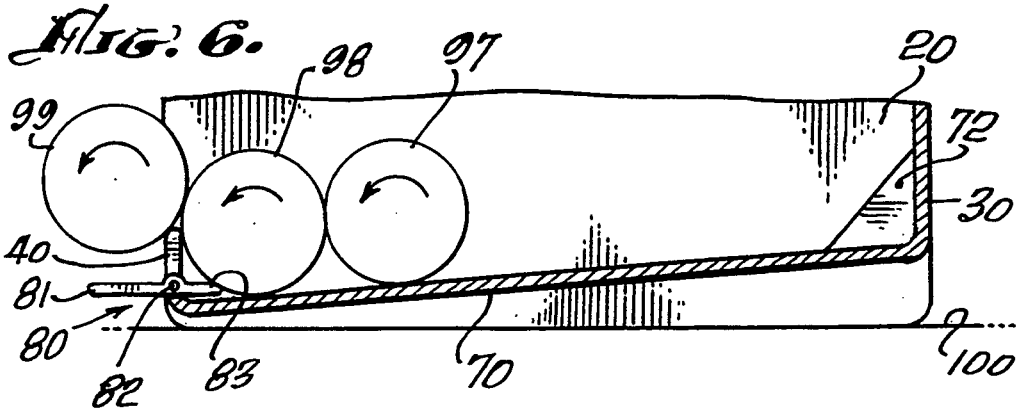
FIG. 6 is the same as FIG. 5 but showing the completion of ejectment of one can.

The stop element 40 has been provided with side tabs as shown and a cut-out sufficient to allow for the stopping of the cans, but also to provide a means for ejectment. The cans, with this particular configuration can be easily ejected one at a time by the use of a special ejectment mechanism which is shown in FIG. 4, 5 and 6 or other suitable means. The ejectment mechanism is shown to be of such configuration that downward pressure on the end 81 of level arm 80 which is pivoted at 82 to end stop 40 causes the can 99 to elevate slightly. At this point, the pressure of the cans behind it and now beneath its center line, causes can 99 to roll up over the lips of element 40 and out into a hand conveniently. The arm extension 83 and the pivot arrangement are such that it cannot pivot so far up that extension 83 will be over the center line of the incoming can. Thus when the one can is flipped out the ejectment device returns to the position as shown in FIG. 4 and again in FIG. 6.

While the embodiments of this invention, specifically shown and described is fully capable of achieving the objects and advantages desired, it is to be understood that such embodiment has been shown for purposes of illustration only and not for purposes of limitation.

I claim:

1. The beverage can dispenser for use in a refrigerator comprising in combination: a first side; a second side; an end connecting said first and second sides on the facing edges thereof; a first shelf means angularly disposed in a downward direction from the front to the rear of said sides and fastened to said sides in such manner as to provide sufficient open space to accommodate the diameter of a beverage can, a second shelf similar to said first shelf and angularly disposed beneath said first shelf and running downwardly from the front toward the rear parallel to said first shelf providing a similar opening through which a can may roll, a third shelf beneath said second shelf connected to the end of the dispenser and angularly disposed in a downward direction from the back to the front of the dispenser and connected between the first side and second side, a generally u-shaped front stop piece fixedly connected to said third shelf at its front end and to said sides at their front edges suitable to stop a can from rolling out and having sufficient space above it and beneath said second shelf to enable a can to pass between them; and means operable cooperatively with said stop piece for lifting one can at a time for ejecting it by means of the pressure on said can from other cans on said third shelf wherein the means operable cooperatively with said stop piece for lifting one can at a time is pivotally mounted on an upper surface of said stop piece and does not lift said can over a top of the stop piece.

* * * * *